United States Patent [19]

Lampman

[11] 4,030,592

[45] June 21, 1977

[54] STENCIL CUTTING APPARATUS

[75] Inventor: Duncan L. Lampman, Carterville, Ill.

[73] Assignee: Diagraph-Bradley Industries, Inc., Herrin, Ill.

[22] Filed: Jan. 20, 1976

[21] Appl. No.: 650,739

[52] U.S. Cl. ..... 197/6.4; 197/84 R; 101/19

[51] Int. Cl.[2] ..... B41J 1/24

[58] Field of Search ..... 197/6.4, 6.6, 6.7, 84 R, 197/84 B, 89; 101/128.4, 19; 74/411, 422

[56] References Cited

UNITED STATES PATENTS

| | | | |
|---|---|---|---|
| 1,350,428 | 8/1920 | Tiefel | 197/6.4 |
| 2,300,297 | 10/1942 | Lampson | 197/6.4 |
| 2,980,226 | 4/1961 | Inoue | 197/6.4 |
| 3,277,990 | 10/1966 | Jackson | 197/6.4 |
| 3,277,991 | 10/1966 | Weber et al. | 197/6.4 |
| 3,307,673 | 3/1967 | Jackson | 197/6.4 |
| 3,330,395 | 7/1967 | Weber | 197/6.4 |
| 3,589,205 | 6/1971 | Radovic | 74/411 X |
| 3,854,418 | 12/1974 | Bertin | 74/422 X |

*Primary Examiner*—Robert E. Bagwill
*Assistant Examiner*—Paul T. Sewell
*Attorney, Agent, or Firm*—Koenig, Senniger, Powers and Leavitt

[57] ABSTRACT

Apparatus for cutting a stencil comprising a frame, a type disk having a circular series of raised type characters on one face thereof, the disk being rotatably mounted on the frame so as to bring a selected character to a stencil cutting station, a carriage for holding the stencil to be cut, and a mechanism for moving the carriage and stencil carried thereby. This mechanism comprises an axially movable plunger, a rack segment on the plunger, a pinion gear engageable by the rack segment as the plunger is moved axially, and a drive from the pinion to the carriage including a one-way clutch for indexing the carriage laterally with respect to the printing station a predetermined increment corresponding to the desired spacing between typed characters of the stencil to be cut.

14 Claims, 7 Drawing Figures

STENCIL CUTTING APPARATUS

BACKGROUND OF THE INVENTION

This invention relates to apparatus for cutting a stencil, and more particularly to such apparatus for cutting a so-called soft stencil.

Generally known prior art stencil cutting machines utilize a disk having a series of raised characters on one face thereof, the disk being rotatable to bring a selected character into position at a printing station. A pressing member, such as a roller, is moved past the printing station to press a stencil against the selected type character. Typically, the stencil is carried by a carriage which is indexed laterally with respect to the printing station a predetermined increment to provide uniform spacing between the characters forming a line of type on the stencil being cut. However, upon changing type sizes, it has heretofore been difficult to change the increment through which the carriage was moved for spacing purposes.

Reference may be made to such U.S. Pat. Nos. as 3,277,990, 3,277,991, 3,307,673 and 3,330,395 which disclose stencil cutting machines in the same general field as the apparatus of the present invention.

SUMMARY OF THE INVENTION

Among the several objects of this invention may be noted the provision of a stencil cutting apparatus in which the size of the stencil characters may readily be changed and in which the spacing of the carriage may readily be varied to accommodate stencil characters of different size; the provision of such apparatus which will accommodate a stencil which is relatively long from top to bottom and in which the spacing between the lines of type characters may be readily and infinitely adjusted; the provision of such apparatus which is of relatively simple and rugged construction and which is easy to repair; the provision of such apparatus which substantially eliminates jamming during operation; the provision of such apparatus which may readily be operated to provide a blank space between words and letters in lines of typed characters; and the provision of such apparatus which is economical to manufacture and which is reliable in operation. Other objects and features of this invention will be in part apparent and in part pointed out hereinafter.

Briefly, apparatus of this invention for cutting a stencil comprises a frame, a type disk having a circular series of typed characters on one face thereof, means for rotatably mounting the disk relative to the frame so as to bring a selected character to a stencil cutting station, means for pressing a stencil against the character at the printing station, a carriage for holding a stencil to be cut, and means for moving the carriage and the stencil carried thereby. Specifically, the last-mentioned means comprises an axially movable plunger, a rack segment on the plunger, a pinion gear engageable by the rack segment as the plunger is moved axially, and a drive from the pinion to the carriage including a one-way clutch for indexing the carriage laterally with respect to the printing station a predetermined increment corresponding to the desired spacing between typed characters of the stencil to be cut.

BRIEF DESCRIPTION OF THE DRAWINGS

Corresponding reference characters indicate corresponding parts throughout the several views of the drawings.

BRIED DESCRIPTION OF A PREFERRED EMBODIMENT

Figure 1:
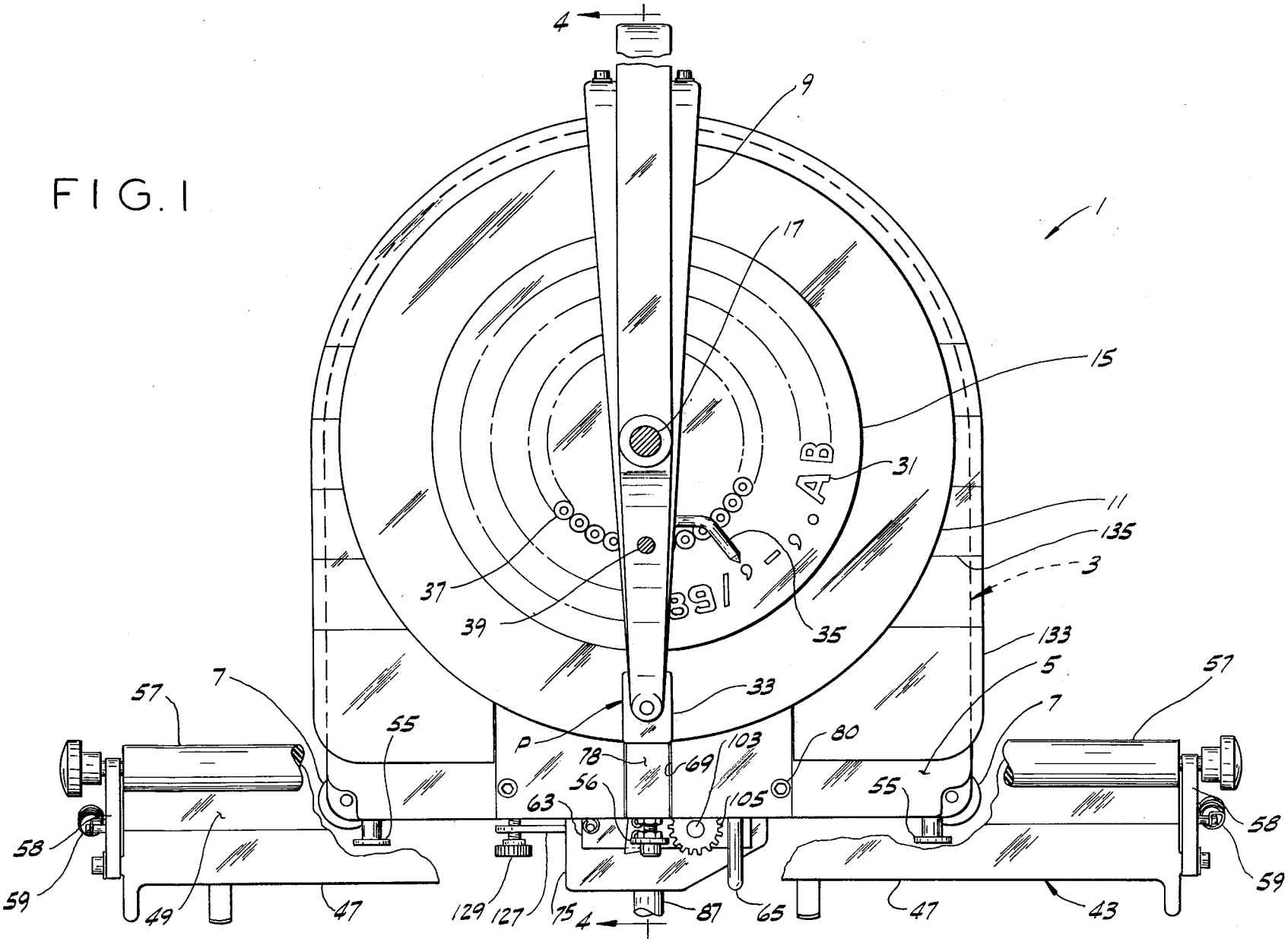
FIG. 1 is a plan view of stencil cutting apparatus of this invention with some parts broken away for clarity.

Referring now to the drawings, a stencil cutting apparatus of this invention is indicated in its entirety at 1. This apparatus is intended for cutting a stencil S (shown in phantom in FIG. 2) which may be a so-called soft stencil. It will be understood that the term "cut a stencil" does not necessarily imply that the stencil be severed, but that an impression is made on the stencil so the stencil may be used to imprint a message. The apparatus is shown to have a frame 3 of cast aluminum or the like having a generally flat, upwardly facing base 5. The frame is supported by three suction cups 7 at its bottom. A rigid arm 9 is cantilevered from one end of the frame (i.e., the back of the frame) to overlie base 5 and to define a throat T (see FIG. 2) extending from the free end of the arm to the back of the frame.

Figures 2, 6:
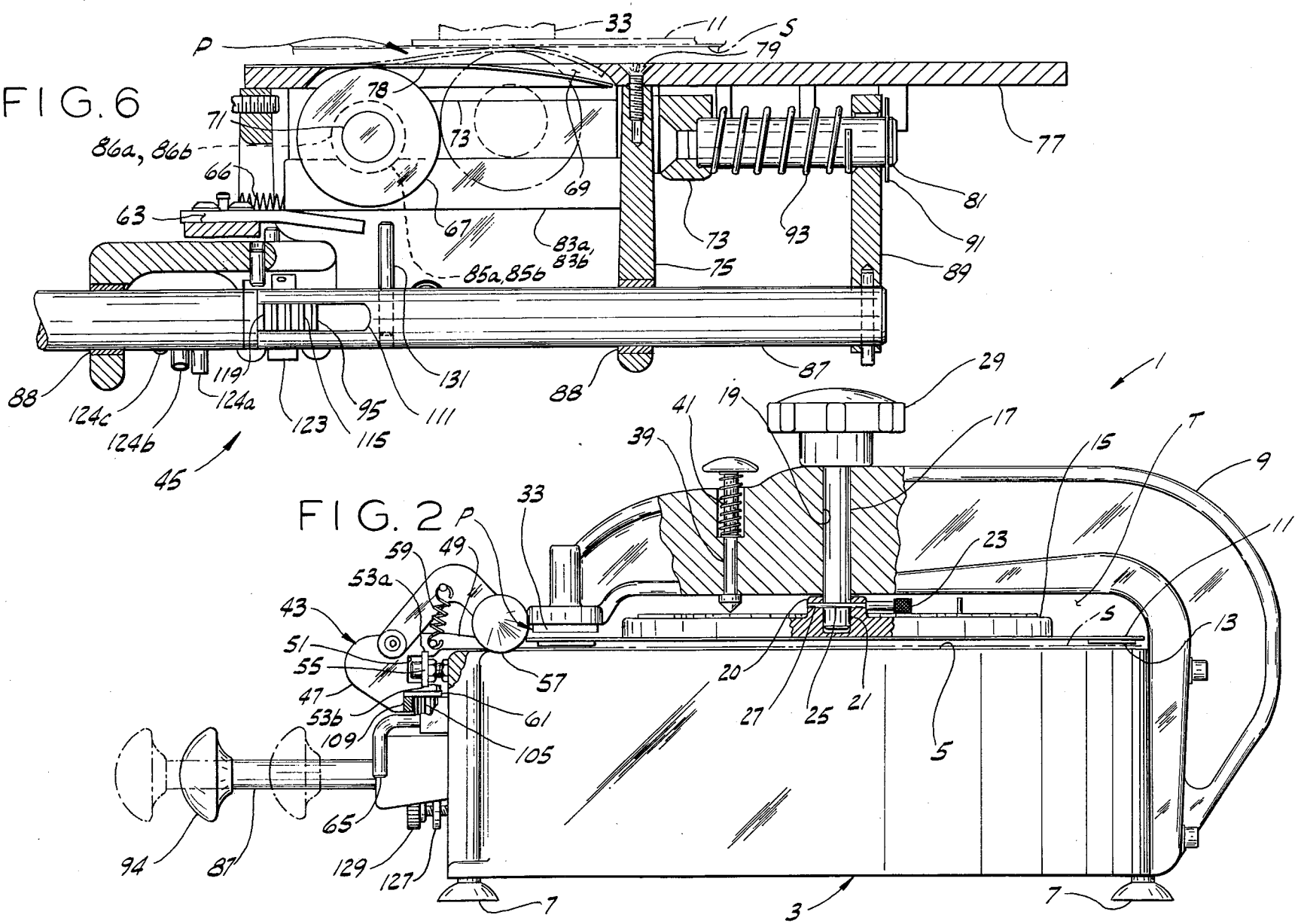
FIG. 2 is a side elevation of the stencil cutting apparatus with some parts broken away.
FIG. 6 (sheet 2) is a longitudinal cross section taken on line 6—6 of FIG. 5.

A circular type disk 11 is rotatably mounted at its center on arm 9 for rotation in a horizontal plane above base 5. The disk has a circular series of type characters 13 on its bottom face. More particularly, disk 11 may be of relatively thin sheet metal and the type characters may be raised on one face of the disk as by chemically milling the disk away in a selected pattern adjacent the characters. The disk is secured to a rigid circular center plate 15 of substantially greater thickness than the disk, the center plate and the disk being concentric. As shown in FIG. 2, the center plate and the disk are rotatably mounted on arm 9 by a spindle 17 journalled in a bore 19 in the arm. The center plate has a boss 20 at its center with a bore 21 extending into the boss for reception of spindle 17. A removable pin 23 is insertable through respective holes 27 and 25 in boss 20 and in spindle 17 to removably secure the type disk to the spindle. By mounting the type disk as above-specified, a stencil S may be inserted into throat T up to the full depth thereof for being cut by the apparatus of this invention. Spindle 17 has a knob 29 at its upper end for rotating the type disk. Center plate 15 has a circular series of characters 31 (see FIG. 1) on its upper face corresponding to type characters 13. Type characters 31 are, however, angularly displaced from characters 13 on the bottom face of disk 11. The outer end of arm 9 carries an anvil 33 which is disposed immediately above the upper face of disk 11 and which serves as a back-up for the disk to resist upward movement of the disk. Anvil 33 constitutes a printing station P at which a character is imprinted on a stencil S positioned between a type character 13 on disk 11 below anvil 33 and base 5. A pointer 35 points to a character 31 on center plate 15 so as to indicate the corresponding character 13 positioned beneath the anvil. The center plate has a circular series of alignment or index holes 37 (see FIG. 1) equally spaced therearound in its upper face, there being one hole for each character 13 on disk 11. An alignment pin 39 having a pointed lower end is carried by arm 9 for vertical movement between a retracted position (shown in FIG. 2) in which the pin is clear of the center plate and an alignment position (not shown) in which the pin is received by one of the alignment holes thereby to properly hold a character 13 in its proper position at printing station P. A compression coil 41 surrounds alignment pin 39 and biases it toward its retracted position.

As generally indicated at 43, a carriage is provided for holding a stencil S in position for being cut at printing station P and for indexing the stencil laterally with respect to the printing station for cutting a line of characters having a predetermined spacing therebetween so that the characters are equally spaced relative to one another. Generally, carriage 43 is indexed by a means as indicated at 45 (see FIG. 6) and as will be explained in detail hereinafter.

Figure 3:
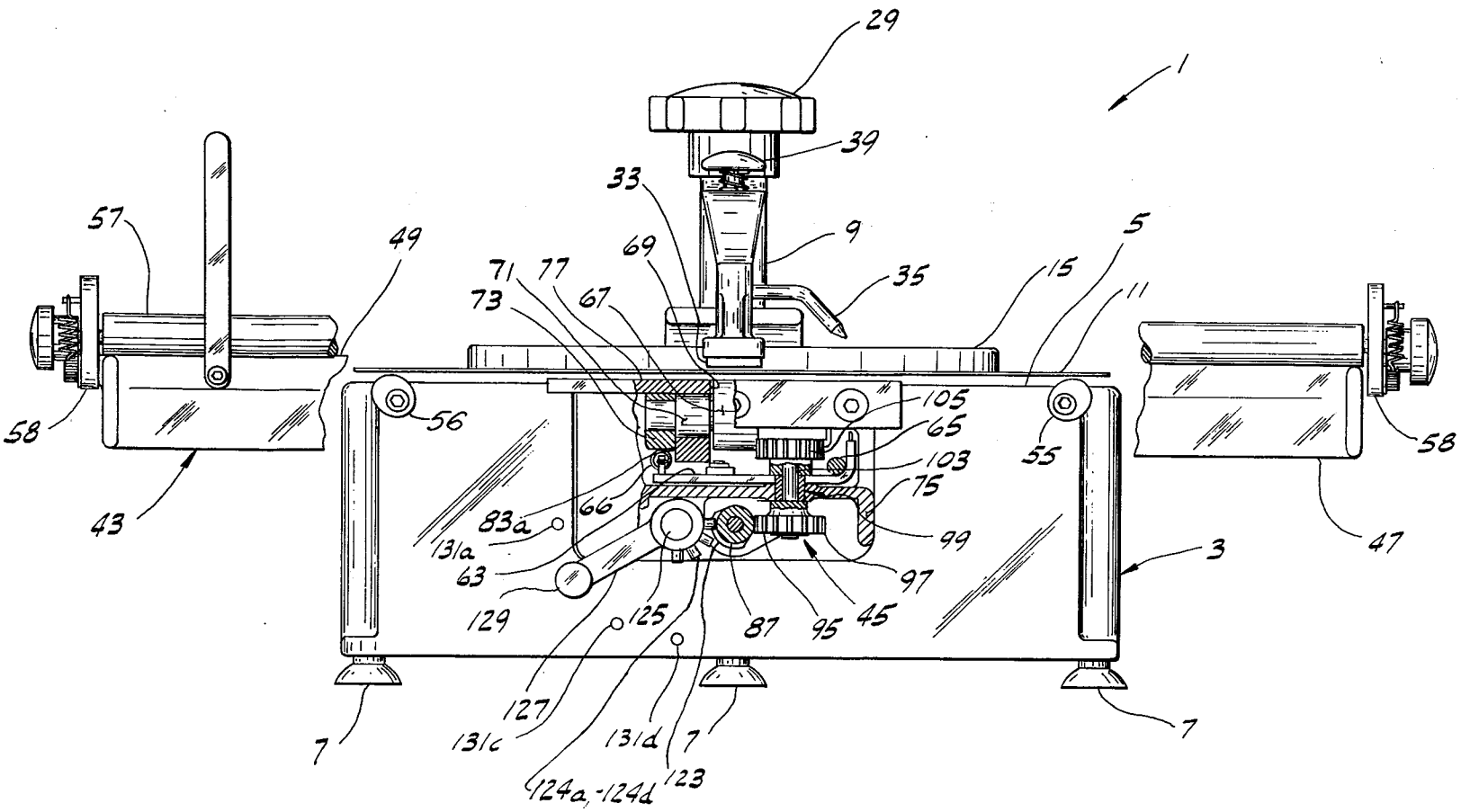
FIG. 3 is a front elevation of the apparatus with parts broken away.

More particularly, carriage 43 is slidably mounted on frame 3 at the front of the frame for lateral movement relative to the frame. The carriage is shown to comprise a carriage body 47 having an upwardly facing surface 49 on which stencil S is supported and an inwardly facing generally U-shaped groove 51 extending laterally of the carriage. Groove 51 has upper and lower keyways 53a and 53b, respectively, therein for reception of guides 55 and 56 carried by the frame 3 and subframe 75 thereby to slidably mount the carriage on the frames and to permit lateral sliding movement of the carriage relative to the frame. Carriage 43 has a stencil holding roller 57 carried by pivot arms 58 resiliently biased into engagement with surface 49 by springs 59 (see FIG. 3) at both sides of the carriage so as to resiliently hold the stencil in position relative to the carriage as the latter is indexed with respect to frame 3. At the bottom of the carriage a ratchet rack 61 is secured to the carriage with its teeth facing frame 3. As shown in FIG. 3, an escapement pawl 63 is pivotally secured to subframe 75 and is pivotally movable between a latching position (shown in solid lines) in which it engages the teeth of ratchet rack 61 thereby to prevent movement of the carriage in one lateral direction (i.e., to the left as viewed in FIG. 1) and a release position (not shown) in which it is clear of the ratchet rack thereby permitting the carriage to move laterally in either direction. Escapement pawl 63 has a handle 65 for manual release of the carriage and is biased toward its engaging position by means of a tension coil spring 66.

Stencil S is pressed against type character 13 to cut the stencil at printing station P by means of a pressing wheel 67 (see FIGS. 4 and 6) mounted below the level of base 5 movable in a slot 69 beneath anvil 33 to forcibly press the stencil into engagement with a raised type character 13. More particularly, wheel 67 is movable from a lowered retracted position (as shown in solid lines in FIGS. 4 and 6) in which the top of the wheel is positioned below the level of base 5 thereby permitting stencil S to be freely moved between the disk 11 and base 5 and a raised pressing position (shown in phantom) in which the top of the roller is substantially at the level of the bottom surface of anvil 33. With the roller in its raised pressing position, it is moved substantially along the length of slot 69 thereby to forcibly press the type character against the stencil. As best shown in FIG. 6, wheel 67 is journalled on an axle 71. This axle is carried by a yoke 73 translatable in horizontal direction relative to a subframe 75. This subframe has a top cover plate 77 which has slot 69 formed therein. A protective strip of non-spring material 78 such as a flexible synthetic resin material, is secured to plate 77 and is disposed over slot 69 between stencil S and wheel 67 thereby to protect the stencil from being rubbed as the wheel moves along the slot in its raised pressing position. The subframe 75 is removably secured to cover plate 77 by a plurality of screws 79 (see FIG. 6) and this subassembly of 75 and 77 is in turn secured to frame 3 by a plurality of screws 80 (see FIG. 1), whereby the subassembly may be readily removed from and installed in the apparatus as a unit. Yoke 73 has a rod end 81 extending endwise therefrom. A pair of rollers 82a, 82b (see FIG. 7) is journalled on axle 71, one roller at each outer end of the axle. These rollers cammingly engage a respective cam bar 83a, 83b each having a respective recess 85a, 85b therein. These cam bars are fixedly secured to subframe 75. With rollers 82a, 82b received in recesses 85a, 85b, wheel 67 is positioned in its lowered retracted position and with the rollers in engagement with the upper faces of these cam bars, the wheel is in its raised pressing position.

Yoke 73 and wheel 67 are reciprocated by means of a manually operated plunger shaft 87 carried by slide bushings 88 (see FIGS. 4–7) on subframe 75 for axial sliding movement relative to the subframe. The plunger shaft is coupled to rod end 81 of yoke 73 by means of a lost motion bar 89 fixedly secured to the inner end of the plunger shaft and slidably received on rod end 81. A snap ring 91 on the outer end of rod end 81 prevents endwise movement of bar 89 relative to the yoke and a compression coil spring 93 surrounds the rod end and is interposed between the yoke and bar 89 for purposes as will appear. Plunger shaft 87 has a knob 94 at its outer end. With rollers 82*a*, 82*b* on axle 71 received in recesses 85*a*, 85*b*, yoke 73 is positioned in a home position and plunger 87 is in a first or starting position (shown in solid lines in FIG. 2). Plunger 87 is movable axially inwardly from its starting position to a second position (shown in phantom). As the plunger moves inwardly lost motion bar 89 engages stop ring 91 and moves yoke 73 from its home position so that rollers 82*a*, 82*b* cammingly engage the upper faces of cam bars 83*a*, 83*b* thereby to move wheel 67 to its raised pressing position and to move the wheel along slot 69 under anvil 33 so as to cut stencil S. With plunger shaft 87 in its second position, wheel 67 is positioned generally at the inner end of slot 69. As plunger 87 is moved axially outwardly from its second position to its starting position, bar 89 slides along rod end 81 and partially compresses spring 93 thereby to bias the yoke back toward its home position. The yoke is restrained from further movement beyond its home position by subframe 75. Plunger 87 is further axially movable outwardly from its starting position to a third position (also shown in phantom in FIG. 2) thereby to effect operation of the carriage index means 45. As the plunger is pulled outwardly, lost motion bar 89 slides along rod end 81 toward yoke 73 so as to further compress spring 93. Upon releasing the plunger, it is resiliently biased by the spring back toward its starting position.

Thus, it can be seen that in order to operate the stencil cutting apparatus 1 of this invention, one needs merely to position a stencil S as on carriage 43 and to rotate disk 11 until the select character 31 is lined up with point 35. Alignment pin 31 is then depressed to accurately position the selected type character at printing station P and plunger 87 is pushed inwardly from its starting position to its second position and then pulled outwardly to its starting position thereby to cut a character in stencil S. Carriage 43 is accurately spaced or indexed by pulling plunger 87 outwardly from its starting position to its third position and releasing the plunger to return to its starting position.

Index means 45 is shown (see FIG. 5) to comprise a rack segment 95 carried on plunger shaft 87, and an input pinion gear 97 engageable by the rack segment as the plunger is moved outwardly from its starting position to its third position. A drive 99 including a one-way clutch 101 (see FIG. 7) indexes carriage 43 through a predetermined increment corresponding to the desired spacing between type characters 13 to be cut in stencil S.

One-way clutch 101 is secured to subframe 75. Input pinion gear 97 is carried by the one-way clutch which in turn is secured to a shaft 103. An output pinion gear 105 is secured to and driven by output shaft 103. The output pinion is in mesh with a gear rack 109 (see FIGS. 2 and 4) secured to and extending laterally of carriage 43. Rack segment 95 is received in an axial slot 111 (see FIG. 5) provided in plunger shaft 87, the rack segment being secured to the plunger shaft by a screw 113. The rack segment has a plurality of gear teeth 115 integral with the rack segment in spaced relation to one another at a fixed pitch. The input pinion gear has a plurality of gear teeth 117 having the same pitch as rack teeth 115. At the leading end of the rack segment (i.e., its end which is first engageable with the input pinion as the plunger is pulled outwardly from its starting position), a movable tooth 119 (see FIG. 5) is movably secured to the rack segment. More specifically, movable tooth 119 is a relatively flat plate of the approximate width of the rack segment and is of a height substantially longer than the height of rack teeth 115. The movable tooth is secured to the rack segment by an elongate slot and pin connection 121 so that the movable tooth is free to move inwardly toward plunger shaft 87. A block of elastomeric material 122 (such as a hard rubber or the like) is disposed in slot 111 and the lower end of the movable tooth is engageable therewith. As the tooth moves inwardly, the elastomeric material is compressed and the tooth is biased outwardly. Upon plunger shaft 87 being pulled outwardly from its starting position to its third position, movable tooth 119 is the first tooth of the rack segment to engage teeth 117 of input pinion gear 97. Depending on the initial rotary position of the input pinion gear, a tooth 117 of the pinion gear may contact the end of movable tooth 119 in a manner which forces the movable tooth inwardly. Because tooth 119 is free to move inwardly, plunger shaft 87 may continue to move outwardly without jamming. It will be noted that if tooth 119 were fixedly mounted on the rack segment, jamming of the rack segment and the input pinion gear may result. At 136 is indicated a brake for input pinion 97, adjustable by means of a screw 137, the brake having a bevel as indicated at 139 so that it pivots toward or away from the face of the pinion on adjustment of the screw. It will also be noted that after movable tooth 119 deflects and slides past the pinion tooth with which it could have jammed in some cases, were it not movable, it moves back out into engagement with the pinion and performs as any of the other rack teeth 115. Thus, the movable tooth 119 and brake 136 constitutes the anti-jamming means when brake 136 is so adjusted by screw 137 that friction of the movable tooth against the crest of the interfering pinion tooth is not enough to move the input pinion.

As plunger 87 is pulled out to its third position and as rack segment 95 meshes with input pinion gear 97, the latter is rotated in one direction through a predetermined angle as the plunger moves outwardly. While input pinion gear 97 rotates in this one direction, one-way clutch 101 is uncoupled and its output pinion gear 105 remains stationary. Upon plunger shaft 87 being pushed inwardly from its third position toward its starting position, rack segment 95 rotates the input pinion gear in the opposite direction through the above-mentioned angle. When the input pinion is rotated in this other direction, one-way clutch 101 drives output pinion gear 107 through a predetermined angular increment. Since the output pinion gear is in mesh with carriage rack 109, carriage 43 is positively driven or indexed through a predetermined increment. This predetermined increment corresponds to the angle through which output pinion 105 is driven which in turn corresponds to the length of stroke of rack segment 95 and plunger 87 from the position of the rack segment when it first engages input pinion gear 97 to its position when the plunger is fully pulled out to its third position. It will thus be noted that the index increment may be varied by varying the stroke of the plunger as it moves from its starting position to its third position.

Figures 4, 7:
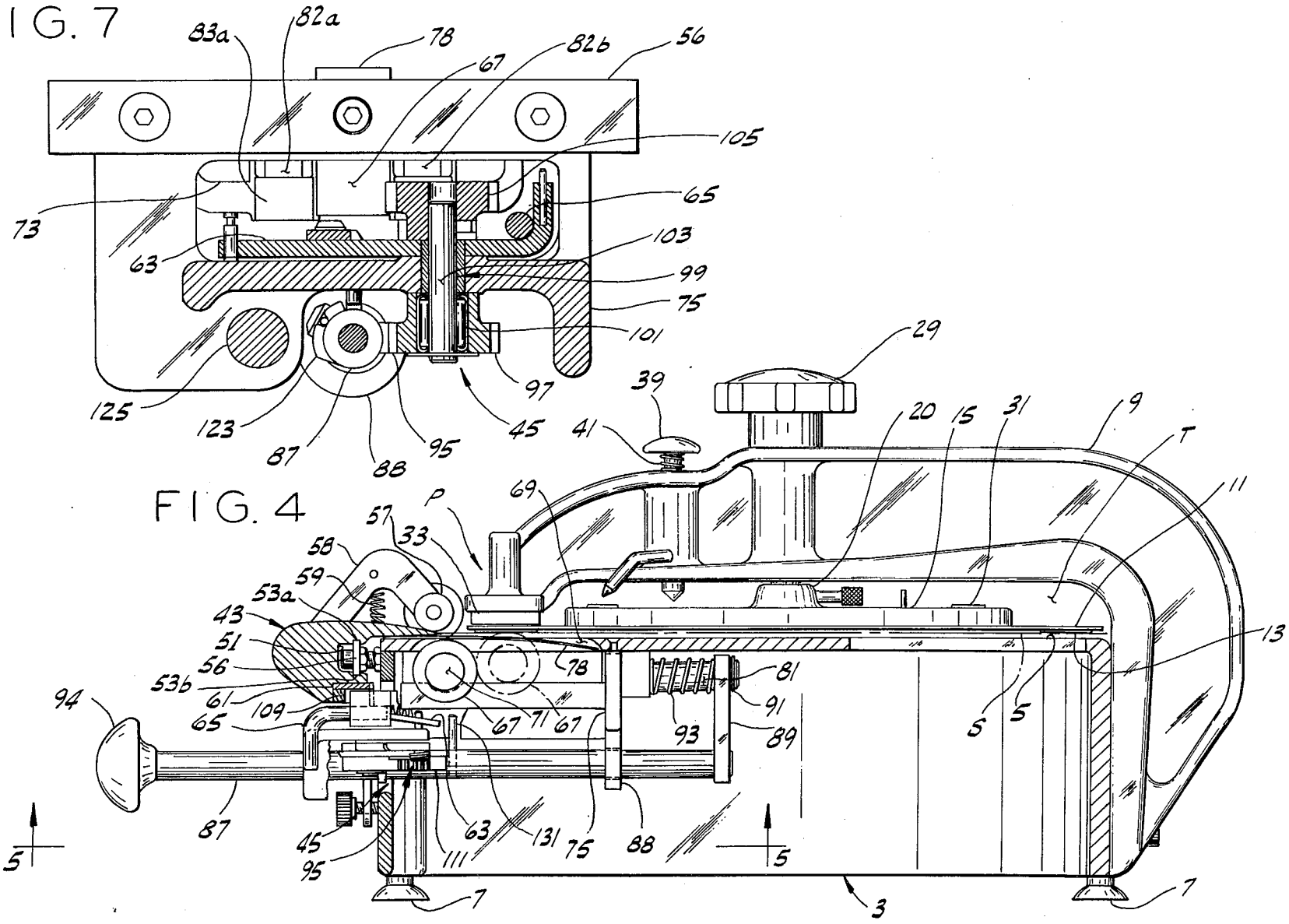
FIG. 4 is a vertical cross section taken on line 4—4 of FIG. 1.
FIG. 7 (sheet 4) is a cross sectional view taken on line 7—7 of FIG. 5.
Figure 5:
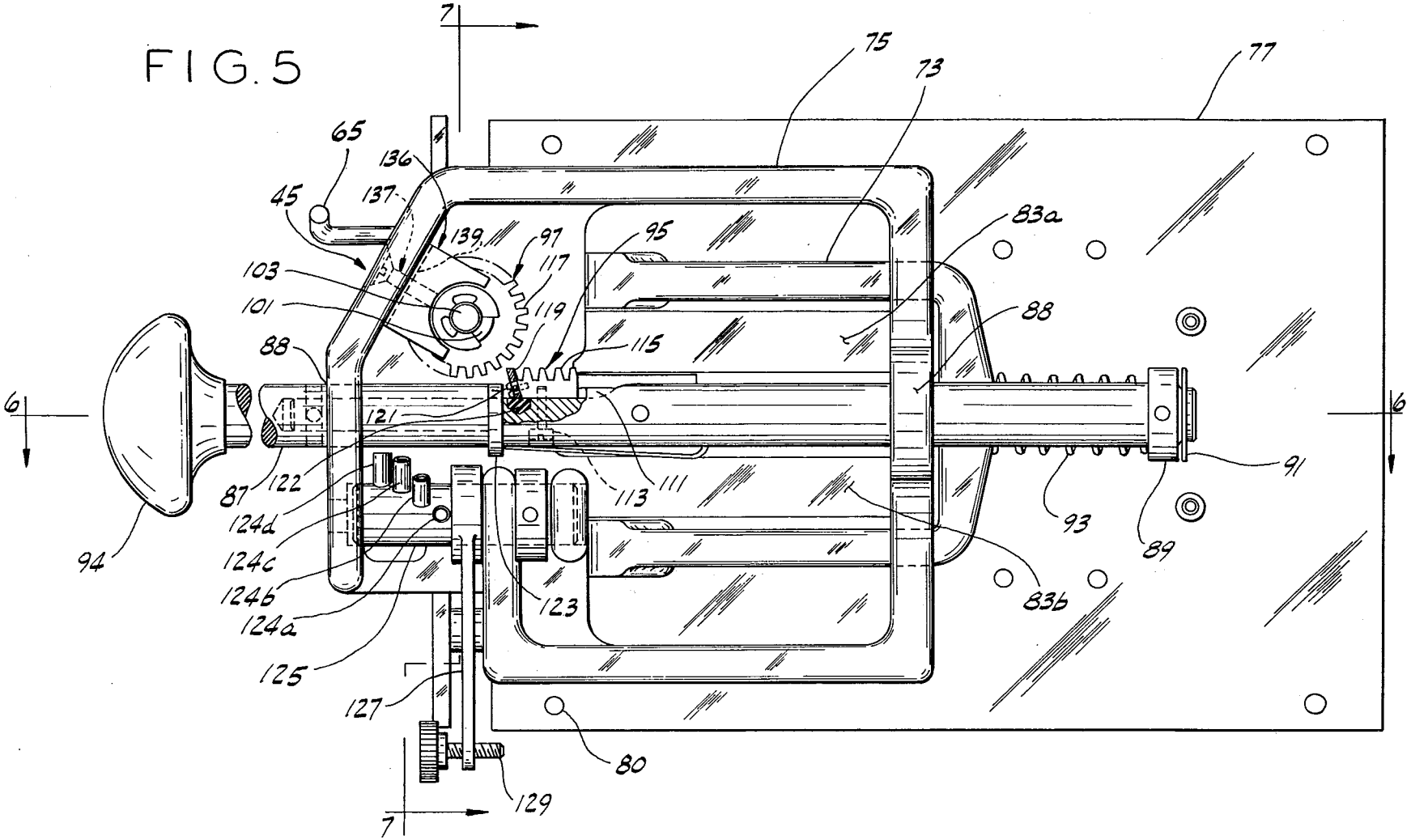
FIG. 5 is an enlarged partial bottom view of the apparatus taken on line 5—5 of FIG. 4 illustrating stencil cutting and indexing means.

As best shown in FIGS. 5 and 7, plunger 87 has a lug 123 fixed thereto intermediate its ends. A series of stops **124*a*–124*d* is carried by subframe 75 for engagement with lug 123 thereby to arrest further outward movement of the plunger and to define the third position of the plunger. More particularly, stops 124*a*–124*b* are shown to be rigid pins extending radially from a shaft 125 disposed parallel to plunger shaft 87, this shaft 125 being rotatably carried by subframe 75. These stops are spaced from one another longitudinally along shaft 125 and are angularly offset on the shaft (i.e., the stops are spaced along a helical path on shaft 125) so that the shaft may be rotated about its longitudinal axis to a plurality of operating positions in which only one of the stops is in position for engagement by lug 123 as the plunger is pulled outwardly toward its third position. It will be understood that the longitudinal spacing of the stops on shaft 125 corresponds to different predetermined angles through which pinions 97 and 105 are to be rotated so as to index carriage 43 through different predetermined increments. A lever 127 is secured to shaft 125 and is rotatable with the shaft. The lever carries a set screw 129 on its opposite end for engagement with a circular series of recesses 131*a*–131*d* (see FIG. 3) on frame 3, these recesses being arranged so that with screw 129 received in one of them a corresponding stop 124*a*–124*d* is in position for engagement by lug 123. By loosening screw 129, lever 127 and shaft 125 may be selectively rotated to any of its predetermined operating positions and then screw 129 may be tightened to lock the shaft in its desired operating position. In this manner, the indexing or spacing of carriage 43** may readily be adjusted.

It will be noted that plunger 87 carries a rigid pin 131 (see FIGS. 4 and 6) engageable with escapement pawl 63 as the plunger is moved outwardly from its starting position toward its third position thereby to pivotally move the pawl out of engagement with ratchet rack 61 so as to release carriage 43 for being indexed. As the plunger moves inwardly toward its starting position from its third position, pin 131 allows the escapement pawl to return to its latching position in which it engages the ratchet rack and prevents further movement of the rack relative to the frame 3 in line ending direction (i.e., it prevents further movement of the carriage to the left as viewed from the front of the apparatus).

As previously mentioned, the subassembly of subframe 75 and cover plate 77 may readily be removed from frame 3 upon removal of screws 80, to facilitate repair of the stencil cutting apparatus of this invention.

As indicated at 133 (see FIG. 1), a guide plate is provided on the top face of base 5. This guide plate has a series of alignment marks or lines 135 thereon which serve as a reference or guide for aligning stencil S with the line of characters to be cut in the stencil at printing station P.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for cutting a stencil comprising:

a frame;

a type disk having a circular series of type characters on one face thereof;

means for rotatably mounting said disk relative to said frame so as to bring a selected character to a stencil cutting station;

means for pressing a stencil against said selected character at said station;

a carriage for holding a stencil to be cut with the stencil between said disk and said pressing means; and means for moving the carriage and the stencil carried thereby comprising an axially movable plunger, a rack segment on the plunger, a pinion gear engageable by the rack segment as the plunger is moved axially, and a drive from the pinion gear to said carriage including a one-way clutch for indexing said carriage laterally with respect to said station a predetermined increment corresponding to the desired spacing between type characters of the stencil to be cut, said plunger being operably connected to said pressing means for actuation of the latter, and being movable relative to the frame from a starting position to a second position and then is movable from its second position to its starting position, said plunger effecting actuation of said pressing means as it is moved between its starting and second positions, said plunger being further movable from said starting position to a third position and thence to its said starting position for indexing said carriage said predetermined increment, said pinion gear being engageable by said rack segment as said plunger is moved from its starting position to said third position and said drive being driven by said pinion gear via said one-way clutch as said plunger is moved from its third position to its starting position thereby to move said carriage through said predetermined increment.

2. Apparatus as set forth in claim 1 further comprising means for varying the increment through which said carriage is indexed including means for selectively varying the angle through which said rack segment rotates said pinion gear as said plunger moves from its starting position to its third position and returns to its starting position.

3. Apparatus as set forth in claim 2 wherein said means for varying the increment through which said carriage is indexed comprises a lug carried by said plunger and a series of stops engageable with said lug thereby to vary the stroke of said plunger as it moves from its starting position to its third position.

4. Apparatus as set forth in claim 3 wherein said plunger is slidable axially inwardly and outwardly relative to said frame, and wherein said apparatus further comprises a shaft rotatable about its longitudinal axis, said shaft being substantially parallel to said plunger and carrying said series of stops, the latter being spaced axially from one another along said shaft and being spaced angularly from one another around the shaft, said shaft being selectively rotatable between a series of predetermined operating positions in which only one of said stops is in position for engagement by said lug.

5. Apparatus as set forth in claim 4 further comprising means for locking said shaft in any one of its said predetermined operating positions.

6. Apparatus as set forth in claim 1 further comprising means for preventing jamming of said rack segment and said pinion gear as said plunger is moved from its starting to its third position.

7. Apparatus as set forth in claim 6 wherein the anti-jamming means comprises a movable tooth at one end of said rack segment constituting the leading end of said rack segment first engageable with said pinion gear as said plunger is moved from its starting to its third position, said movable tooth being movable generally inwardly relative to said plunger upon jammingly engaging said pinion gear as said plunger is moved from its starting position toward its third position thereby to permit the movable tooth of the rack to slide by the interfering pinion tooth and then to snap back into mesh with the next tooth of said pinion gear.

8. Apparatus as set forth in claim 9 further comprising means for biasing said movable tooth outwardly away from said plunger.

9. Apparatus as set forth in claim 8 wherein said biasing means comprises means interposed between the inner end of said movable tooth and said plunger.

10. Apparatus as set forth in claim 7 further comprising an adjustable brake operable on said pinion gear for preventing movement of said pinion gear upon said movable rack tooth interferingly engaging a pinion tooth.

11. Apparatus as set forth in claim 8 wherein said movable tooth has a slot therein and is secured to said rack segment by a fastener received in said slot and secured to said rack thereby to permit in and out movement of the movable tooth relative to the plunger.

12. Apparatus for cutting a stencil comprising:

a frame;

a type disk having a circular series of type characters on one face thereof;

means for rotatably mounting said disk relative to said frame so as to bring a selected character to a stencil cutting station;

means for pressing a stencil against said selected character at said station;

a carriage for holding a stencil to be cut with the stencil between said disk and said pressing means; and means for moving the carriage and the stencil carried thereby comprising an axially movable plunger, a rack segment on the plunger, a pinion gear engageable by the rack segment as the plunger is moved axially, and a drive from the pinion to said carriage including a one-way clutch for indexing said carriage laterally with respect to said station a predetermined increment corresponding to the desired spacing between type characters of the stencil to be cut, said drive further comprising a gear rack carried by said carriage and extending laterally thereof, and an output pinion gear driven by said one-way clutch, said output pinion gear being in mesh with said carriage rack whereupon said output pinion gear being driven by said one-way clutch through a predetermined angle, said carriage is indexed laterally through said predetermined increment.

13. Apparatus set forth in claim 1 wherein said frame has a base and a rigid arm cantilevered from one end of the base to overlie the base and to define a throat extending substantially from the free end of said arm to said one end of said base, said free end of said arm constituting a back-up for said disk at said station, and wherein said disk is rotatably mounted on said arm with clearance between said disk and said base whereby a stencil may be inserted into said throat up to the full depth thereof.

14. Apparatus as set forth in claim 1 further comprising a subframe carrying said pressing means and said means for moving the carriage, said subframe being releasably secured to said frame whereby said subframe along with said pressing means and said carriage moving means may readily be removed from the frame as a unit.

* * * * *

UNITED STATES PATENT AND TRADEMARK OFFICE

CERTIFICATE OF CORRECTION

PATENT NO. : 4,030,592

DATED : June 21, 1977

INVENTOR(S) : Duncan L. Lampman

It is certified that error appears in the above-identified patent and that said Letters Patent are hereby corrected as shown below:

Column 2, line 17, "BRIED" should read -- BRIEF --. Column 6, line 38, "stops 124a - 124b" should read -- stops 124a - 124d --. Column 8, claim 8, line 1, "claim 9" should read --claim 7 --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*